US006276348B1

(12) United States Patent
Skinner et al.

(10) Patent No.: US 6,276,348 B1
(45) Date of Patent: Aug. 21, 2001

(54) IGNITION COIL ASSEMBLY WITH SPOOL HAVING RAMPS AT BOTH ENDS THEREOF

(75) Inventors: Albert Anthony Skinner; Viorel Moga, both of Anderson, IN (US); Antony V. Hirudayaraj, Sacramento, CA (US); Norman H. Bracken, Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/482,131

(22) Filed: Jan. 12, 2000

(51) Int. Cl.[7] ..... F02P 15/00; H01F 27/28
(52) U.S. Cl. ..... 123/634; 336/179; 336/198
(58) Field of Search ..... 123/634, 635; 336/96, 198, 179

(56) References Cited

U.S. PATENT DOCUMENTS 5,706,792 1/1998 Boyer et al. ..... 123/634
5,736,917 4/1998 Kawano et al. ..... 336/90
5,929,736 * 7/1999 Sakamaki et al. ..... 336/96

FOREIGN PATENT DOCUMENTS

09246075-A * 9/1997 (JP) .

* cited by examiner

*Primary Examiner*—Tony M. Argenbright
(74) *Attorney, Agent, or Firm*—Margaret A. Dobrowitsky

(57) ABSTRACT

An ignition coil assembly adapted to be mounted directly in a plug hole of an internal combustion engine. The coil assembly includes a primary coil and a secondary coil. The spool upon which the secondary coil is wound is cylindrical in shape and has ramp structures provided at each end thereof. The ramps decrease voltage concentration between the secondary and primary windings, decrease the voltage gradient along the end wall of the secondary spool, and minimize adverse effects of gaps created during thermal expansion/contraction.

9 Claims, 5 Drawing Sheets

IGNITION COIL ASSEMBLY WITH SPOOL HAVING RAMPS AT BOTH ENDS THEREOF

TECHNICAL FIELD

The present invention relates to an ignition coil assembly, and more particularly to a pencil coil wherein a spool thereof has a ramp provided at each end.

BACKGROUND OF THE INVENTION

Ignition coils for internal combustion engines adapted to be directly coupled to spark plugs are known. For example, see U.S. Pat. Nos. 5,706,792 and 5,736,917, the disclosures of which are hereby incorporated herein by reference. It is known that conventional ignition coils (or pencil coils) utilize both a primary coil and a secondary coil. The primary coil is typically a low voltage coil, while higher voltages are induced in the secondary coil.

Prior art FIG. 2 illustrates a conventional spool 100 upon which a secondary coil is wrapped or wound. Secondary spool 100 includes a cylindrical mid-section 102 upon which the windings 106 are wrapped. Spool 100 further includes planar flanges 104 extending outwardly at approximately a 90 degree angle from each end of the mid-section.

Unfortunately, the provision of this type of flange 104 at both ends of the spool is problematic. For example, the 90 degree angle or corner 108 defined by the flange and the end of the mid-section wind-on surface may cause a voltage concentration between the secondary and primary windings, at the high voltage end of the secondary winding.

Another problem inherent with flanges 104 at both ends of the spool arises upon thermal expansion. The thermal coefficient of expansion of the spool is typically much higher than that of the wire 106. There may be relative movement between the flange 104 and the end 110 of the wire segment upon exposure to high temperatures, thereby creating a gap adjacent one or both of flanges 104. When a flexible encapsulant is used, this gap could allow a collapse of the winding, which could increase stress when the coil returns to a hot condition. The collapse could also increase the wire to wire voltage gradient which may lead to electrical failure.

It is apparent from the above that there exists a need in the art for an ignition coil or pencil coil: having a secondary spool requiring a lessor number of wire turns/wraps; allowing for a reduction of voltage concentration between the secondary winding and the primary spool; and/or for minimizing adverse effects upon separation between the spool and coil upon thermal expansion/contraction.

SUMMARY OF THE INVENTION

Generally speaking, this invention fulfills any or all of the above described needs in the art by providing a pencil coil assembly for providing a spark to a cylinder of an internal combustion engine, the coil assembly comprising:

an outer housing;

a primary coil disposed within said outer housing, said primary coil adapted to be connected to a voltage source;

a secondary coil wound on a spool, said spool including first and second ends; and wherein a first ramp structure is defined proximate said first end of said spool and a second ramp structure is defined proximate said second end of said spool.

This invention further fulfills any or all of the above described needs in the art by providing an ignition coil assembly for use in conjunction with an engine, the ignition coil assembly comprising:

a spool having a midsection including a coil-receiving surface upon which a coil is wound; and wherein the spool includes first and second ramp structures at opposite ends thereof upon which the coil is wound.

This invention will now be described with respect to certain embodiments thereof, along with reference to the accompanying illustrations.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENT

Figure 1:
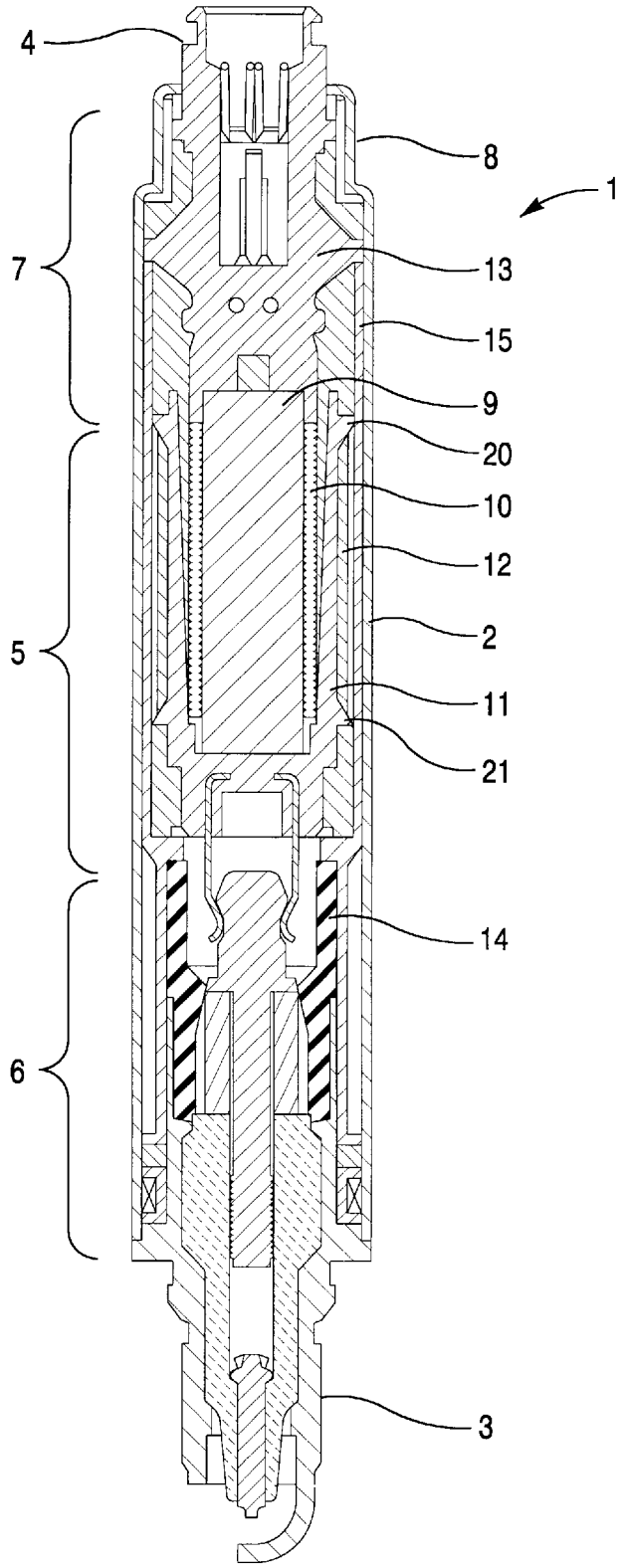
FIG. 1 is a sectional view of an integrated ignition coil assembly for direct attachment to a spark plug of an internal combustion engine according to an embodiment of this invention.
Figure 2:
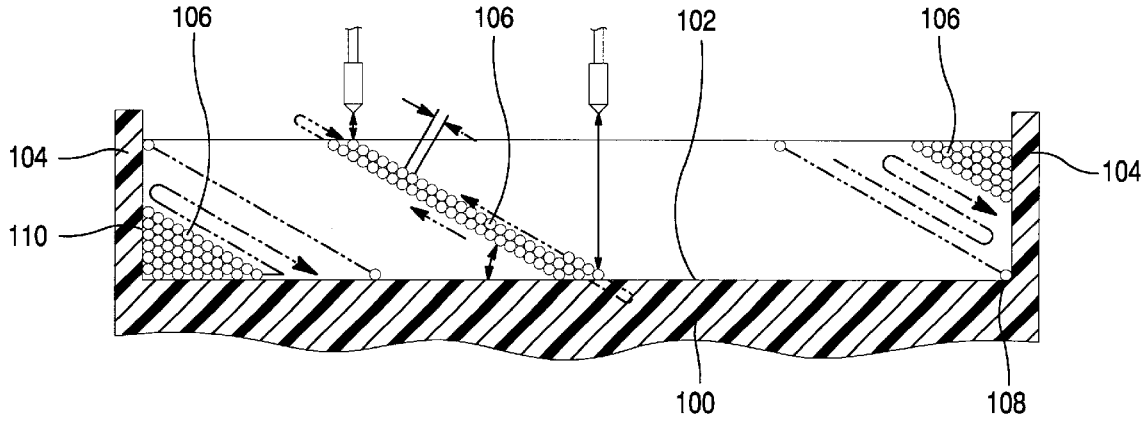
PRIOR ART FIG. 2
FIG. 2 is a prior art sectional view of a conventional secondary winding spool.

Preferred embodiments of the present invention are hereinafter described with reference to the accompanying drawings, in which like reference numerals refer to like parts throughout the several views.

Figure 6:
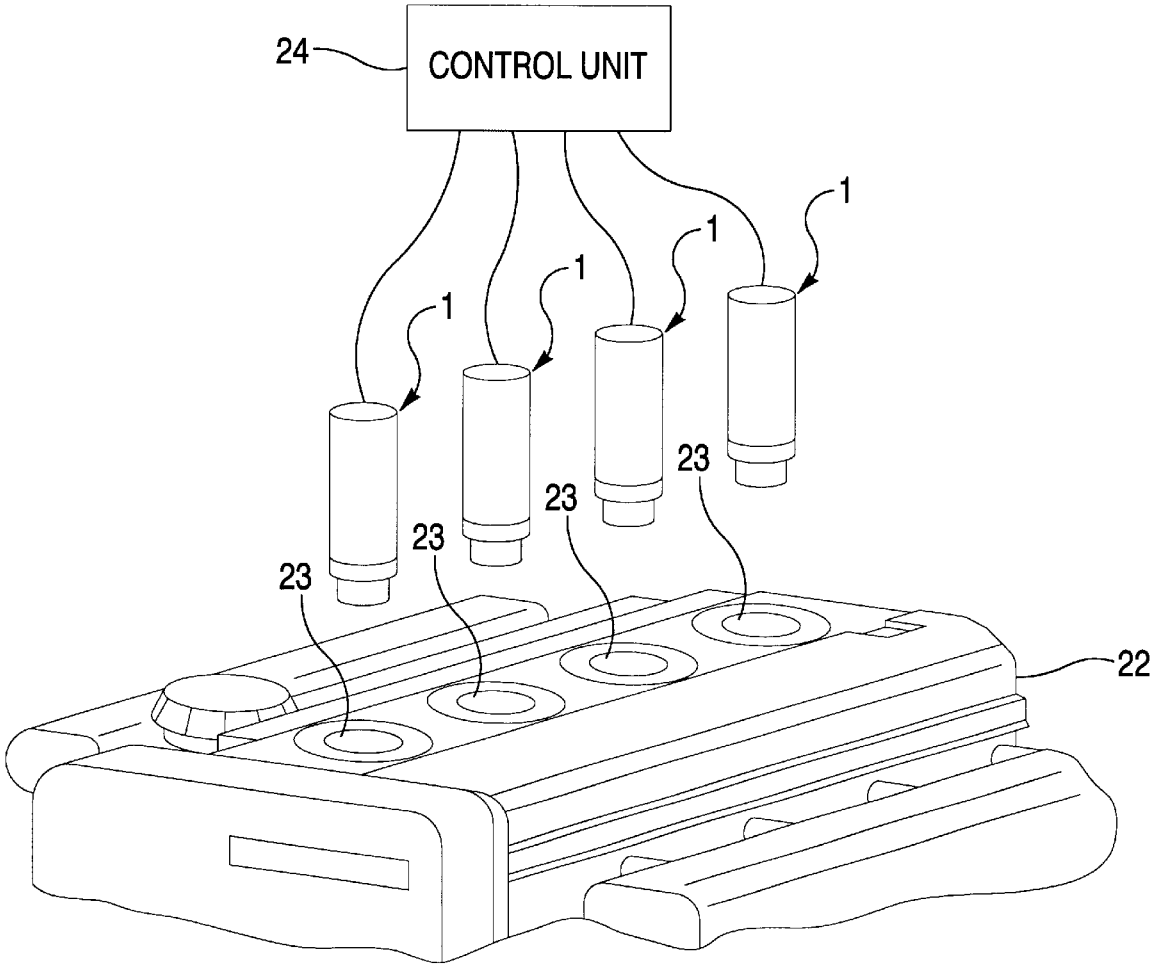
FIG. 6 is an exploded view of the ignition coil assembly of FIG. 1 together with an engine and a control unit of an embodiment of this invention.

FIG. 1 generally illustrates an ignition coil assembly 1 in accordance with an embodiment of this invention. As shown in FIG. 6, ignition coil assembly 1 (or pencil coil) is adapted for installation in a conventional internal combustion engine 22 through a spark plug shell and to be in threaded engagement with a spark plug opening 23 into a combustion cylinder.

A primary focus of certain embodiments of this invention will be secondary spool 11 upon which the secondary winding 12 is wound. The provision of ramps 20 and 21 at first and second opposing ends of secondary spool 11 results in many advantages which will be discussed in detail below. However, prior to discussion of the specifics of ramps 20 and 21, a general discussion of the coil assembly 1 is deemed appropriate.

Referring to FIG. 1, ignition coil assembly 1 has a substantially rigid outer housing 2 at one end of which is a spark plug assembly 3 and at the other end of which is a control circuit interface portion 4 for external electrical interface with the engine control unit (or electronic control module) 24. Assembly 1 further includes a high voltage transformer including substantially coaxially arranged primary 10 and secondary 12 coil windings and a high permeability cylindrically shaped magnetic core 9.

Housing 2 is preferably composed of steel. A transformer portion 5 and a control-circuit portion 7 are inserted in outer coil housing 2. The control-circuit portion 7 responds to instruction signals from an external circuit (not shown) to cause primary current of the transformer portion 5 to be intermittent. It is noted that the control circuit may be internal or external to the integrated coil/spark plug assembly.

A connecting portion 6 which supplies secondary voltage induced from the transformer portion 5 to the spark plug 3 is provided in a lower portion which is at another end of the outer coil housing 2.

The outer housing 2 may be formed from round tube stock preferably comprising nickel-plated 1008 steel or other adequate material. Where higher strength may be required, such as for example in unusually long cases, a higher carbon steel or a magnetic stainless steel may be substituted. A portion of the outer housing 2 at the end adjacent the control circuit interface portion 4 is preferably formed by a conventional sewage operation to provide a plurality of flat surfaces to provide a fastening head 8, such as a hexagonal fastening head for engagement with standard sized drive tools. Additionally, the extreme end is rolled inward to provide necessary strength for torque applied to the fastening head 8. The previously assembled primary and secondary sub-assemblies are loaded into the outer housing 2 from the spark plug end to a positive stop provided by the swaged end acting on a top end portion of the connector body.

The transformer portion 5 is formed around a central magnetic core 9. The magnetic core 9 may be manufactured from plastic coated iron particles in a compression molding operation. After the core 9 is molded, it is finish machined such as by grinding to provide a smooth surface absent for example sharp mold parting lines otherwise detrimental to the intended direct primary coil winding 10 thereon. Laminating thin silicon-steel plates of differing widths so that a cross-section thereof becomes substantially circular may also form the core 9. Magnets having polarity of reversed directions of magnetic flux generated by excitation by the coil 10 are disposed respectively on both ends of iron core 9.

The primary coil 10 is wound directly on the cylindrical outer surface of the molded core 9. The windings 10 are typically formed from insulated wire, which are wound directly upon the outer cylindrical surface of the core 9. The primary coil 10 may comprise two winding layers each being comprised of from about 120 to 140 turns of No. 23 (or Nos. 21–25) AWG wire in certain preferred embodiments. In certain embodiments, voltages of from about 350 to 450 volts may be present in the primary coil 10, and the wire of that coil may have a diameter of from about 0.5 to 0.7 mm. Insulated copper wire may be utilized. Adhesive coatings, though not needed, may be applied to the primary coil 10 such as by a conventional felt dispenser during the winding process or by way of an injection of liquid silicone rubber about the wire. The winding of the primary coil 10 directly upon the core 9 provides for efficient heat transfer of the primary resistive losses and improved magnetic coupling which is known to vary substantially inversely proportionally with the volume between the primary winding and the core. The core 9 is preferably assembled to the interior end portion of the connector body to establish positive electrical contact between the core 9 and the core-grounding terminal. However, the specific grounding of the core is not essential to the operation of the present invention. The terminal leads of primary coil 9 are connected to the insert molded primary terminals by soldering.

The primary sub-assembly is inserted into the annular and cylindrical secondary spool 11. A secondary coil 12 is wound onto the outer surface of the secondary spool 11. The progressive windings of coil 12 may have from about 15,000 to 25,000 turns or wraps around the mid-section of secondary spool 11. The wire 12 of the secondary coil may have a diameter of from about 0.05 to 0.07 mm in certain embodiments, to create voltage higher than in the primary coil. The thickness or height 22 (see FIG. 3) of the secondary coil 12 may be from about 1 to 2 mm in different embodiments, and voltages of from about 8,000 to 40,000 volts may be induced in the secondary coil 12 by field(s) from the core. Secondary spool 11 may be formed of an injection molded plastic insulating material having high temperature tolerance such as a polybutylene terephthalate (PBT) thermoplastic polyester, LCP, or PPS, for example. The coil 12 on spool 11 may be progressively wound with a gradual flare away from the primary coil such that the space between the inner diameter of the secondary spool and the primary winding progressively increases from the connector body end to the spark plug end of the assembly. The voltage gradient in the axial direction increases toward the spark plug end of the secondary coil 12. In certain embodiments, the secondary coil may be segment wound or layer wound.

Still referring to FIG. 1, the control-circuit portion 7 is preferably made up of a molded-resin switching element which causes conduction current to the primary coil 10 to be intermittent, and a control circuit which is an igniter that generates the control signals of this switching element. Additionally, a heat sink, which is a separate body, may be glued to the control-circuit portion 7 for heat radiation of circuit elements such as the switching element. The interior of the outer housing 2 houses the transformer portion 5, connector portion 13, and a high voltage boot 14.

For the assembly process, the wound primary coil 10 with connector 13 is assembled to the wound secondary spool 11 and then inserted into the coil case 15. The above-described ignition coil is inserted in a plug hole 23 of an internal combustion engine 22 and is fixed to an engine, as shown in FIGS. 1 and 6. A spark plug 3 mounted on a bottom portion of the plug hole 23 is received within the connecting portion 6, and a head-portion electrode of the spark plug electrically contacts an end portion of the transformer portion 5. The steel case on the coil may be welded to the spark plug to form a pre-assembled unit. The pre-assembled unit is then screwed into the spark plug hole 23 in the engine head in a conventional manner. The unit is self-supporting with no attachment bolts required.

It is preferable that the ignition coil assembly have a cross-sectional configuration and dimensions that are housable within the plug hole 23 shown in FIG. 6. According to one embodiment, a tube-portion cross-section of the outer coil housing 2 is formed to be circular so that an inner-diameter dimension accommodates a plug hole 23, and an outer diameter thereof is established to be a suitable dimension as recognized by those skilled in the art.

Generally speaking, the ignition coils assembly operates as follows in certain embodiments. An ECM or electronic control module 24 causes current to flow through primary coil 10. The voltage in the primary coil generates an electromagnetic field. Intermittent provision of the current through the primary coil 10 causes fluctuations in the field. The field(s) generated by the core 9 induce voltage in secondary coil 12 that is wrapped around secondary spool 11. Secondary coil 12 is electrically connected to the spark plug, so that the voltage induced in the secondary coil excites the plug 3 and causes the engine to start/fire.

Figure 3:
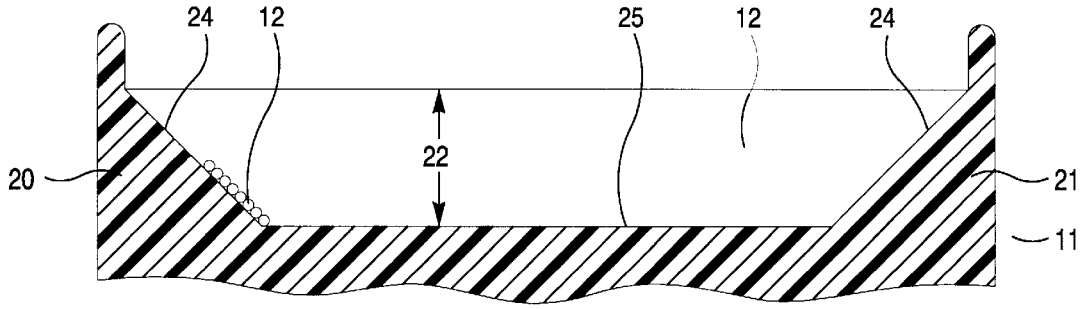
FIG. 3 is a sectional view of a secondary spool according to the FIG. 1 embodiment of this invention, wherein the spool includes a ramp at each end thereof.
Figure 4:
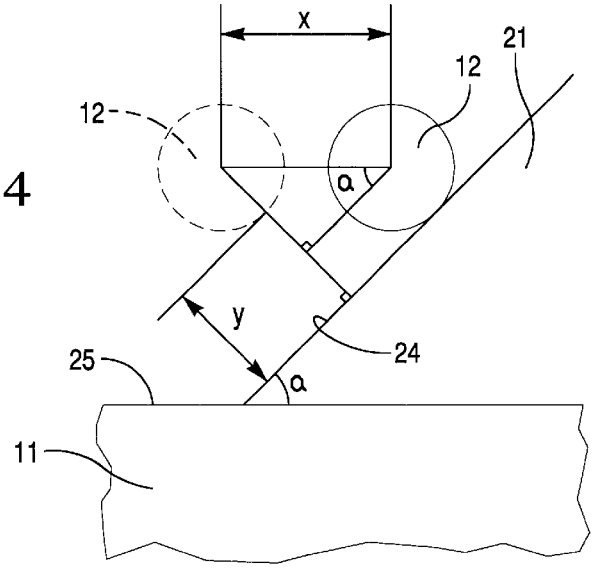
FIG. 4 is a schematic diagram illustrating an advantage of an embodiment of the instant invention over the prior art.

Referring now more particularly to the secondary spool 11 as shown in FIGS. 1, 3 and 4, this spool includes ramp structures 20 and 21 at opposite ends thereof, which ramp away from midsection cylindrical surface 25 of spool 11, at an angle α. The wire-receiving surface 24 of each ramp 20, 21 is frusto-conical in shape and defines an angle α with the wire-receiving cylindrical surface 25 of the spool's midsection. Angle α may be from about 15 to 45 degrees in certain embodiments of this invention, and most preferably is about 30 degrees. The ramp 20 at the starting end of the progressive winding process aids the winding process by setting the angle for a layer of wire wound on the spool 11. Meanwhile, the ramp 21 at the high voltage end, closest to the spark plug, decreases voltage concentration between the secondary winding 12 and the primary spool, which is generally the highest in the coil. This is done by both increasing the distance between the two at the highest voltage point at the end of the secondary coil, and by increasing the angle at which this voltage is presented to the primary coil. The voltage gradient along the end of the spool 11 is also decreased due to the ramps 20, 21, as the ramps allow for fewer turns of wire 12 to fill in either the start or finish areas. Fewer turns of wire decreases the voltage level, and increases the distance over which voltage is distributed, thereby decreasing the gradient. It is noted that the winding of the secondary coil may be "started" at either the high or low voltage end of spool 11, although starting at the low voltage end is preferred in certain embodiments.

Figure 5:
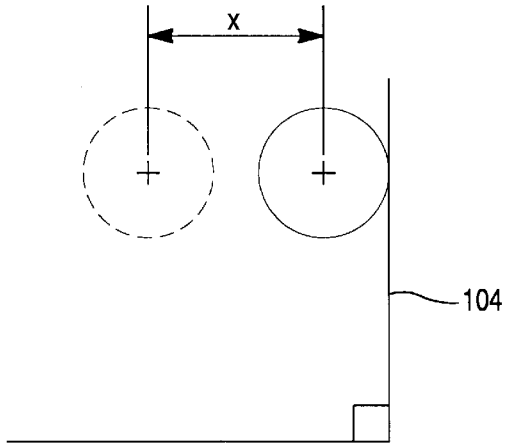
PRIOR ART FIG. 5
FIG. 5 is a schematic diagram illustrating spacing between the spool end and the winding in a prior art assembly.

Another advantage of ramps 20, 21 is illustrated by way of reference to FIGS. 4–5. The coefficient of thermal expansion of dielectric spool 11 (e.g. made of LCP or PPS) is much higher than that of the wire 12. During potting preheat there may be relative movement between the end of the wire segment 12 and the end of the spool, so as to create a gap between the two. In other words, the wire may move a distance "x" away from the end of the spool as shown in FIGS. 4–5. The further the wire moves away from the end of the spool, the more likely a winding collapse. FIG. 5 shows that with a typical prior art flange 104 forming a 90 degree angle with the spool midsection, movement of the wire a distance "x" results in the wire moving "x" distance away from the flange (or the end of the spool). However, FIG. 4 shows the improvement due to ramp 21, because when wire 12 in FIG. 4 moves distance "x" toward the other end of the spool 11, the exterior surface of the wire only moves a distance "y" away from ramp 21 (or the end of the spool). This is an improvement over the prior art, because in FIG. 4 "x" is greater than "y" due to the provision of ramp 21. This is because $y=x \tan(\alpha)$, where α is the angle created between the ramp and an extension of the cylindrical midsection of the spool as shown in FIGS. 3–4. For example, when $\alpha=30$ degrees (i.e. a 30 degree ramp), then approximately 42% more wire movement would be allowed before the wire reached a distance "x" from the spool end, as when $x=9$ then $y=5.2$ units of length.

For the reasons discussed above, ramps 20, 21 also allow for less wire insulation to be used. The benefits of this include reduced cost of the wire. Also, output is increased and heat generation decreased because less insulation is needed in the same space. Secondary coil wire herein may be from about #43 to #46 gauge wire, which is cheaper than smaller gauge wire (larger gauge can be used due to less insulation).

According to the present embodiment, the configuration of the case of the ignition coil is made to be circular, but the present invention is not restricted to this, and an axial cross-sectional configuration formed in a tubular configuration which is pentagonal, octagonal, square, or otherwise polygonal is also acceptable.

Figure 7:
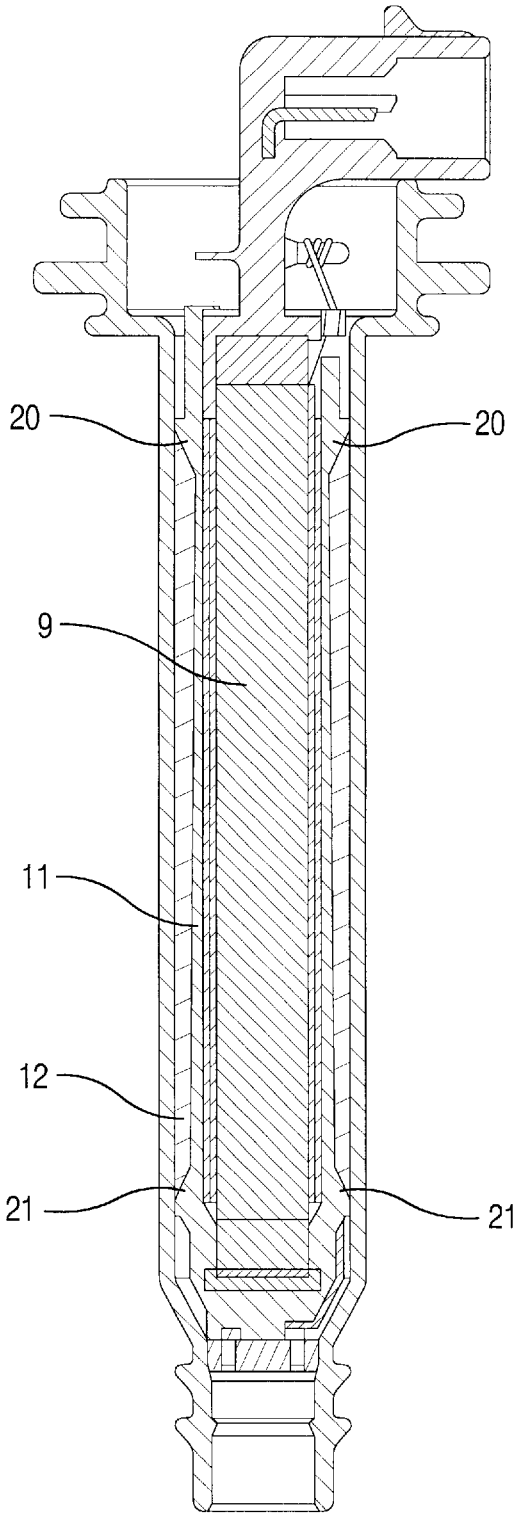
FIG. 7 is a sectional view of a pencil coil for attachment to a spark plug of an internal combustion engine according to another embodiment of this invention.

FIG. 7 is a sectional view of a pencil coil according to another embodiment of this invention. The pencil coil, to be attached to a spark plug, includes core 9, secondary spool 11 upon which secondary winding 12 is wound, and ramps 20, 21 at either end of spool 11. The coil of this embodiment differs from the FIG. 1 embodiment, in that the pencil coil of FIG. 7 is not an integrated spark plug coil. Ramps 20, 21 on spool 11 function as described above with regard to the FIGS. 1, 3–4 embodiment.

The embodiments illustrated herein show the secondary spool surrounding the primary coil and spool, with ramps 20, 21 being provided on the secondary spool. However, in alternative embodiments of this invention, ramps 20, 21 may be provided on any spool in an ignition coil assembly, including but not limited to a secondary spool provided within a primary coil and/or spool.

Still further, according to the present invention, the ignition coil was mounted in a plug hole formed in an engine head cover. However, the present invention is not restricted to this, and an ignition coil for an internal combustion engine which is mounted via a bracket or the like installed on an engine head cover is also acceptable.

Although the present invention has been fully described in connection with the preferred embodiment thereof with reference to the accompanying drawings, it is to be noted that various changes and modifications will become apparent to those skilled in the art. Such other features, modifications, and improvements are, therefore, considered to be a part of this invention, the scope of which is to be determined by the following claims.

What is claimed is:

1. An ignition coil assembly for providing a spark to a cylinder of an internal combustion engine, the coil assembly comprising:

an outer housing;

a primary coil disposed within said outer housing, said primary coil adapted to be connected to a voltage source;

a secondary coil wound on a spool, said spool including first and second ends; and wherein a first ramp structure is defined proximate said first end of said spool and a second ramp structure is defined proximate said second end of said spool wherein each of said first and second ramp structures includes a wire receiving surface upon which said secondary coil is wound, and wherein each of said receiving surfaces ramps at an angle (α) of from about 15 to 45 degrees relative to a wire receiving surface of a midsection of said spool.

2. The coil assembly of claim 3, further comprising a spark plug in electrical communication with said secondary coil to provide a spark when said secondary coil is energized, and wherein said voltage source selectively energizes said primary coil.

3. The coil assembly of claim 1, wherein a substantial portion of said primary coil is provided within said spool and radially interior of said secondary coil.

4. An ignition coil assembly for providing a spark to a cylinder of an internal combustion engine, the coil assembly comprising:

an outer housing;

a primary coil disposed within said outer housing, said primary coil adapted to be connected to a voltage source;

a secondary coil wound on a spool, said spool including first and second ends; and wherein a first ramp structure is defined proximate said first end of said spool and a second ramp structure is defined proximate said second end of said spool wherein each of said wire receiving surfaces of said first and second ramp structures, respectively, ramps at an angle ($\alpha$) of about 30 degrees relative to said wire receiving surface of said midsection of said spool.

5. An ignition coil assembly for providing a spark to a cylinder of an internal combustion engine, the coil assembly comprising:

an outer housing;

a primary coil disposed within said outer housing, said primary coil adapted to be connected to a voltage source;

a secondary coil wound on a spool, said spool including first and second ends; and wherein a first ramp structure is defined proximate said first end of said spool and a second ramp structure is defined proximate said second end of said spool wherein each of said wire receiving surface of said first and second ramp structures, respectively, is approximately frusto-conical in shape, and wherein said wire receiving surface of said midsection of said spool is cylindrical in shape.

6. An ignition coil assembly for use in conjunction with an engine, the ignition coil assembly comprising:

a spool having a midsection including a coil-receiving surface upon which a coil is wound; and wherein said spool includes first and second ramp structures at opposite ends thereof upon which said coil is wound, wherein each of said first and second said ramp structures angle away from said coil receiving surface of said midsection at an angle of from about 15 to 45 degrees.

7. The coil assembly of claim 6, wherein the coil is a pencil coil adapted to be connected to a spark plug of an internal combustion engine.

8. The coil assembly of claim 6, wherein said coil is a secondary coil adapted to be in electrical communication with a spark plug, and wherein said spool is a secondary spool.

9. The coil assembly of claim 8, further including a primary coil and a core each disposed within said secondary spool.

* * * * *